US006805186B1

(12) United States Patent
Nien

(10) Patent No.: US 6,805,186 B1
(45) Date of Patent: Oct. 19, 2004

(54) WINDOW BLIND ASSEMBLY HAVING A DETACHABLE CONTROL SYSTEM

(75) Inventor: Ming Nien, Changhua Hsien (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 0 days.

(21) Appl. No.: 10/442,124

(22) Filed: May 21, 2003

(30) Foreign Application Priority Data

Apr. 9, 2003 (TW) ..... 92205678 U

(51) Int. Cl.[7] ..... E06B 9/26
(52) U.S. Cl. ..... 160/177 R
(58) Field of Search ..... 160/177 R, 177 V, 160/176.1 R, 176.1 V, 168.1 R, 168.1 V, 173 R, 172 R, 178.1 R, 178.1 V

(56) References Cited

U.S. PATENT DOCUMENTS 4,607,974 A * 8/1986 Brothers et al. ..... 403/24
4,759,398 A * 7/1988 Renee ..... 160/178.1 R
4,875,516 A * 10/1989 Marocco ..... 160/178.1 R
5,092,387 A * 3/1992 King et al. ..... 160/176.1 R
5,186,229 A * 2/1993 Hsu ..... 160/176.1 R
6,308,764 B1 * 10/2001 Lin ..... 160/177 R
6,325,133 B1 * 12/2001 Lin ..... 160/177 R

FOREIGN PATENT DOCUMENTS

DE 198 07 050 8/1998

* cited by examiner

*Primary Examiner*—David Purol
(74) *Attorney, Agent, or Firm*—Browdy and Neimark, P.L.L.C.

(57) ABSTRACT

A control system for regulating light-shading status of a window blind assembly is disclosed to include a transmission mechanism and a driving device. The transmission mechanism includes a force receiving member having a receiving portion. The driving device has a force output member detachably connected to the receiving portion of the force receiving member. The receiving portion of the force receiving member is substantially a rod member having a coupling groove extended around a periphery near a bottom end thereof. The force output member has a receptacle connectable to the bottom end of the receiving portion of the force receiving member. The receptacle includes a spring arm having a protruding engagement portion for engaging the coupling groove of the receiving portion upon connection of the receptacle to the receiving portion of the force receiving member.

12 Claims, 4 Drawing Sheets

WINDOW BLIND ASSEMBLY HAVING A DETACHABLE CONTROL SYSTEM

BACKGROUND OF THE INVENTION

1. Field of the Invention

The present invention relates generally to window blind assemblies and, more particularly, to such a window blind assembly, which has a detachable control system.

2. Description of the Related Art

The control system of a regular Venetian blind includes two parts, the lifting control unit and the slat tilting control unit. According to early blind designs, the lifting control unit comprises lift cords extended to the outside for operation by the user. However, because the exposed portions of the lift cords may be hung on the body of a person accidentally, causing death. In order to eliminate this problem, a rotary driving bar is disclosed to match with a transmission mechanism for lifting control instead of conventional lift cords. It is also well known to use a rotary driving rod for controlling the tilting angle of blind slats. In general, a rotary driving rod may be used in a window blind assembly to separately or concomitantly control the lifting of the blind and the tilting of the slats, thereby changing the light shading status of the window blind assembly.

There is known a detachable design of rotary driving rod for use in a window blind assembly to separately or concomitantly control the lifting of the blind and the tilting of the slats. According to this design, the user must prepare a special place to keep the detached rotary driving rod after each use. German Patent No. DE 19807050 A1 discloses a window blind control structure in which the rotary driving rod (2a) is equipped with a steel ball mechanism (7) detachably coupled to a coupling groove (4) in the transmission shaft (1) of the window blind assembly. It is to be noted that the reference numerals recited in this paragraph are directly derived from the German Patent No. DE 19807050 A1. By means of applying a force to the rotary driving rod (2a) in a particular direction, the rotary driving rod (2a) can easily be detached from the transmission shaft (1) of the window blind assembly for use to drive the transmission shaft of another window blind assembly. The design is practical in use. However, the complicated steel ball structure greatly increases the material and assembly costs of the control system.

SUMMARY OF THE INVENTION

It is the primary object of the present invention to provide a window blind assembly, which comprises a detachable control system.

It is another object of the present invention to provide a detachable control system for window blind assembly, which is inexpensive to manufacture.

To achieve these objects of the present invention, the window blind assembly comprises a headrail, a blind unit having slats and a bottom rail and suspended from the headrail, and a control system for regulating light-shading status of the blind unit. The control system comprises a transmission mechanism mounted in the headrail, and a driving device. The transmission mechanism has a force receiving member that is provided with a receiving portion, and actuating means rotatable by the force receiving member to change the light-shading status of the blind unit. The driving device has a handle for operation by the user, and a force output member detachably connected to the receiving portion of the force receiving member of the transmission mechanism. The receiving portion of the force receiving member is a rod member having a coupling groove extended around a periphery near a bottom end thereof. The force output member of the driving device has a receptacle connectable to the bottom end of the receiving portion of the force receiving member. The receptacle has at least one spring arm, each spring arm having a protruding engagement portion projecting in direction toward a central axis of the receptacle for engaging the coupling groove of the receiving portion of the force receiving member upon connection of the receptacle to the receiving portion of the force receiving member.

DETAILED DESCRIPTION OF THE INVENTION

Figure 1:
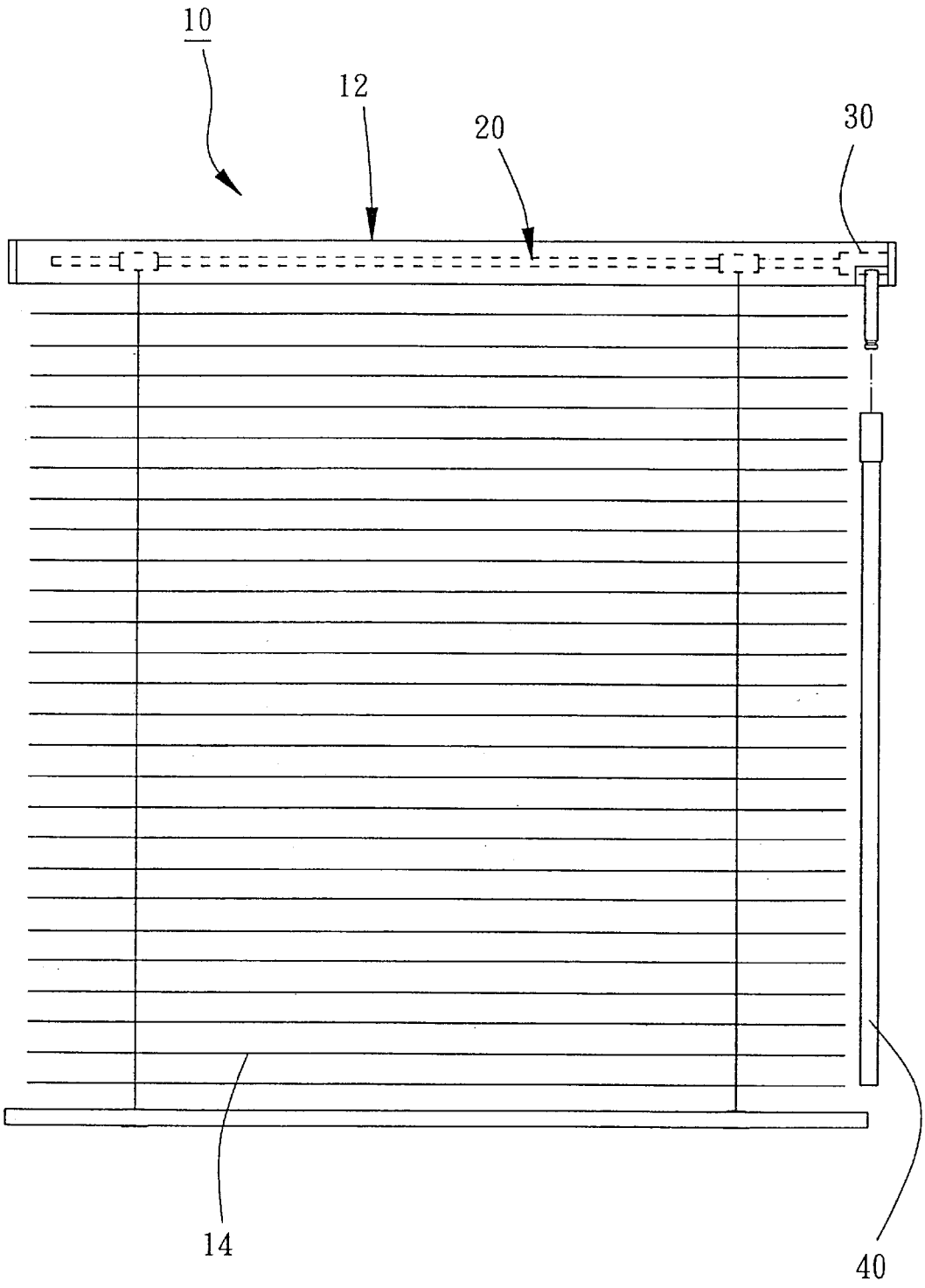
FIG. 1 is a schematic drawing showing the basic structure of a window blind assembly constructed according to a preferred embodiment of the present invention.

Referring to FIG. 1, a window blind assembly 10 is shown comprised of a headrail 12, a blind unit 14 having a plurality of slats and a bottom rail, and a control system 20. The headrail 12 is transversely fixedly fastened to the top side of the window (not shown). The blind unit 14 is suspended from the bottom side of the headrail 12. The control system 20 is adapted to control the blind unit 14, adjusting the light shading status (separately or concomitantly control the lifting of the bottom rail of the blind unit and tilting of the blind slats). The control system 20 comprises a transmission mechanism 30 installed in the headrail 12, and a driving device 40 detachably coupled to the transmission mechanism 30 and adapted to drive the transmission mechanism 30.

Figure 2:
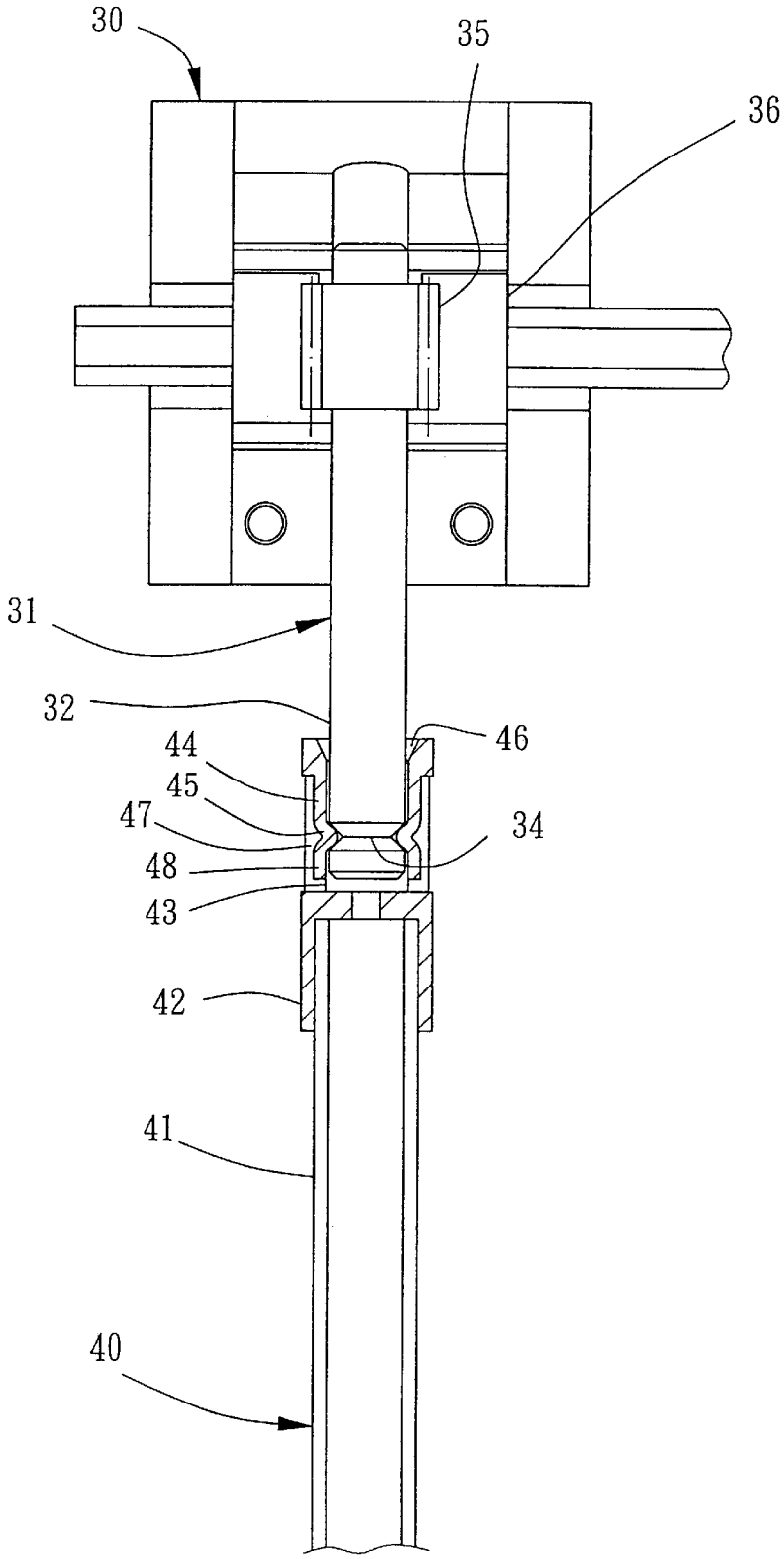
FIG. 2 is a sectional front view, in an enlarged scale, of the control system used in the window blind assembly shown in FIG. 1.
Figure 3:
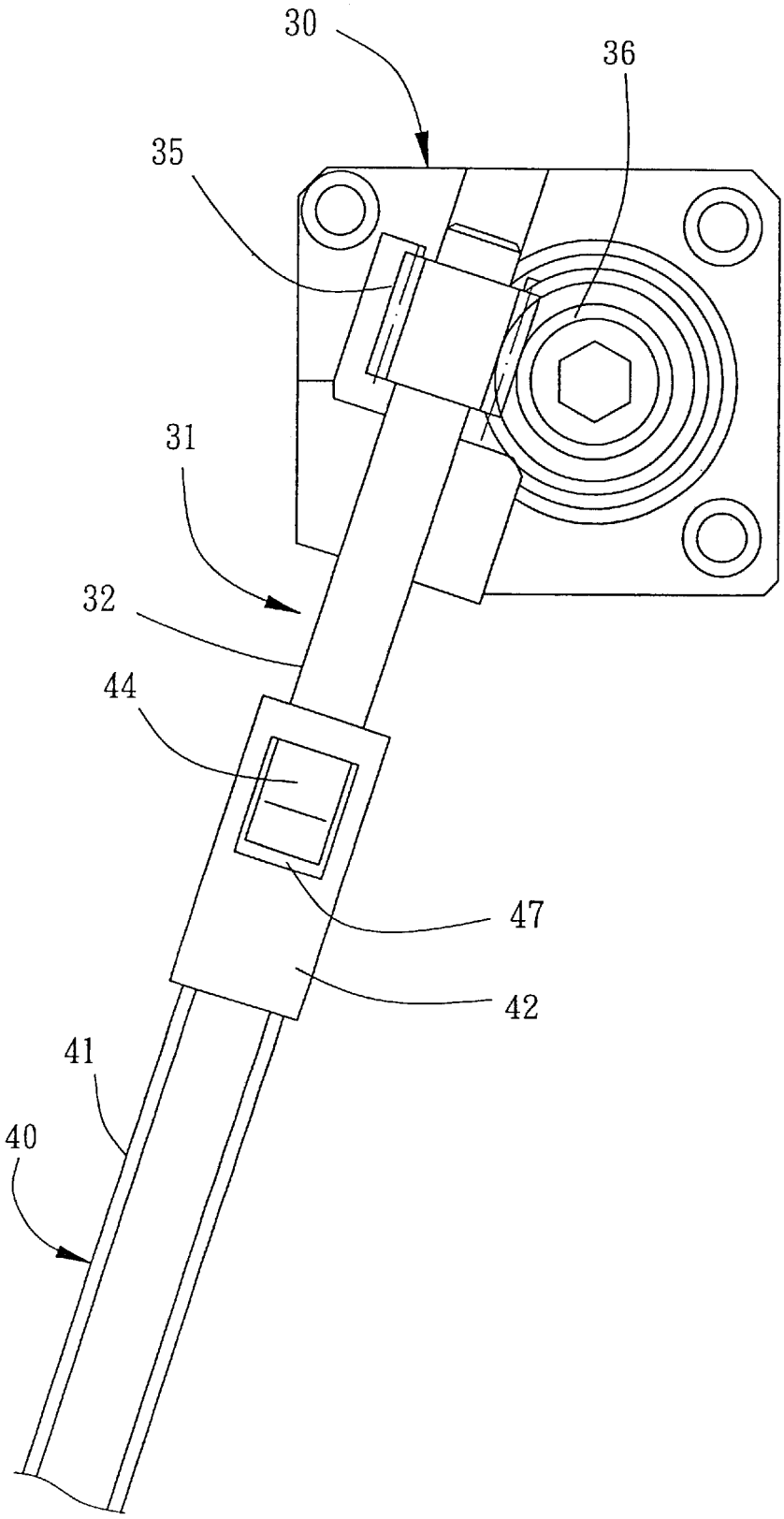
FIG. 3 is a right side view, partially in section of the control system according to the present invention.

Referring to FIGS. 2 and 3, the transmission mechanism 30 comprises a force receiving member 31 rotatably mounted on the inside of the transmission mechanism and obliquely extended to the outside toward the user operation position. The force receiving member 31 is a round rod having a bottom end terminating in a receiving portion 32 suspending outside the headrail 12. The receiving portion 32 has a non-circular, for example, hexagonal cross section, and a coupling groove 34 of V-shaped cross section around the periphery. The transmission mechanism 30 further comprises actuation means having a worm 35 affixed to the top end of the force receiving member 31, and a worm gear 36 meshed with the worm 35. Applying a rotary driving force to the force receiving member 31 causes the worm 35 to rotate the worm gear 36 and to further move the blind unit 14 accordingly.

The driving device 40 comprises a handle 41, and a force output member 42 fixedly mounted on one end, namely, the top end of the handle 41. The force output member 42 has a hexagonal receptacle 43 connectable to the receiving portion 32 of the force receiving member 31 of the transmission mechanism 30 for driving the transmission mechanism 30. The receptacle 43 has a tapered orifice 46, which expands outwards for guiding the receiving portion 32 into the inside of the hexagonal receptacle 43, two side openings 47 spaced from each other at 180°, and two spring arms 44 respectively downwardly suspended from the top of the side openings 47. The spring arms 44 each have a smoothly arched protruding engagement portion 45 projecting toward the central axis of the hexagonal receptacle 43 and adapted to engage the coupling groove 34 of the receiving portion 32, and a downwardly extended straight free end 48.

When the user attaching the force output member 42 to the receiving portion 32 of the transmission mechanism 30 in direction from the bottom side toward the top side, the tapered orifice 46 guides the receiving portion 32 into the inside of the hexagonal receptacle 43, thereby causing the coupling groove 34 to be forced into engagement with the protruding engagement portions 45 of the spring arms 44. Because the spring arms 44 are suspended in the hexagonal receptacle 43 corresponding to the side openings 47, inserting the receiving portion 32 through the tapered orifice 46 toward the inside of the hexagonal receptacle 43 causes the spring arms 44 to curve outwards for enabling the receiving portion 32 to be set into the engagement position. When set into the engagement position, the driving device 40 is coupled to the transmission mechanism 30 for operation. When the user pulling the driving device 40 downwards to disconnect the force output member 42 from the receiving portion 32 of the transmission mechanism 30, the spring arms 44 are forced to curve outwards and to disengage the respective protruding engagement portions 45 from the coupling groove 34, for enabling the driving device 40 to be separated from the transmission mechanism 30. Because the spring arms 44 are formed integral with the hexagonal receptacle 43 of the driving device 40, the manufacturing cost of the driving device 40 is low.

Figure 4:
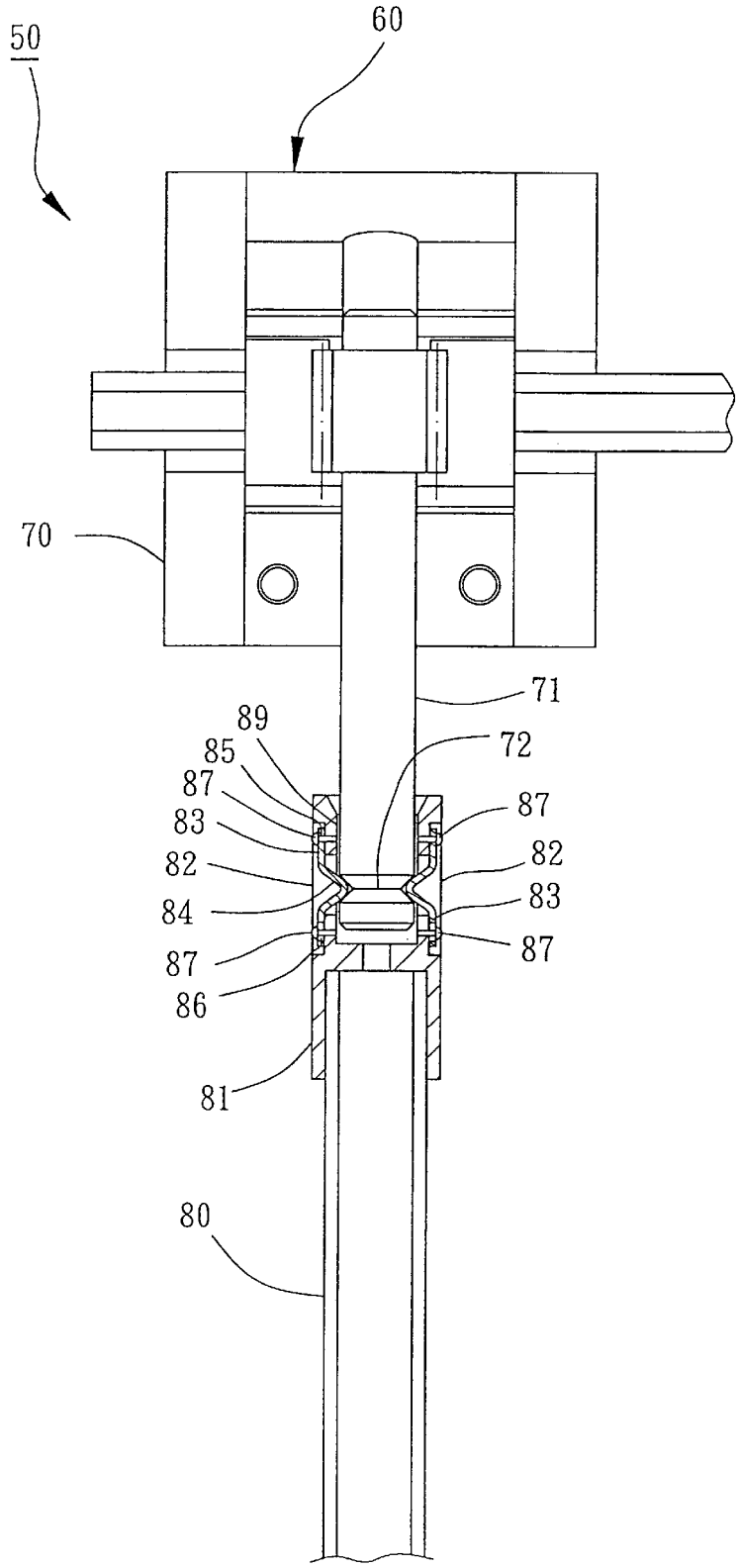
FIG. 4 is a sectional front view of the control system according to another preferred embodiment of the present invention.

FIG. 4 shows an alternate form of the present invention. According to this embodiment, the control system 60 of the window blind assembly 50 is comprised of a transmission mechanism 70 and a driving device 80. The transmission mechanism 60 comprises a rod-like force receiving member 71. The force receiving member 71 has a coupling groove 72 around the periphery near the bottom end. The driving device 80 comprises a force output member 81. The force output member 81 has a receptacle 89 connectable to the bottom end of the force receiving member 71. The receptacle 89 comprises two side openings 82 spaced from each other at 180°, and two spring arms 83 respectively suspended in the side openings 82. The spring arms 83 are curved springy strips of equal thickness, each having a smoothly arched protruding engagement portion 84 on the middle, a circular through hole 85 near the top (fixed) end, and an oblong through hole 86 near the bottom end. Screws 87 are respectively mounted in the circular through hole 85 and oblong through hole 86 of each spring arm 83 to fasten the spring arms 83 to the inside wall of the receptacle 89, keeping the spring arms 83 vertically suspended in the side openings 82. When the spring arms 83 installed, the top end of each spring arm 83 is fixedly secured to the inside wall of the receptacle 89, and the bottom end of each spring arm 83 is coupling to the inside wall of the receptacle 89 through a slit joint (The oblong through hole 86 of each spring arm 83 and the corresponding screw 87 form a slip joint). Therefore, the spring arms 83 can be curved outwards when inserting the force receiving member 71 into the receptacle 89 of the force output member 81 or, when pulling the force output member 81 away from the force receiving member 71.

What is claimed is:

1. A window blind assembly comprising:

a headrail;

a blind unit suspended from said headrail;

a control system for controlling status of said blind unit, said control system comprising:

a transmission mechanism mounted in said headrail and including a force receiving member having a receiving portion extended outside, and actuating means rotatable by said force receiving member to change a light shading status of said blind unit; and a driving device having a handle disposed at one end thereof for operation by the user, and a force output member disposed at an opposite end thereof and detachably connected to the receiving portion of said force receiving member of said transmission mechanism;

wherein said receiving portion of said force receiving member is a rod member having a coupling groove extended around a periphery close to a bottom end thereof; said force output member of said driving device has a non-circular receptacle connectable to the bottom end of said receiving portion of said force receiving member, said receptacle having at least one spring arm, said at least one spring arm each having a protruding engagement portion projecting in direction toward a central axis of said receptacle for engaging the coupling groove of said receiving portion of said force receiving member upon connection of said receptacle to said receiving portion of said force receiving member.

2. The window blind assembly as claimed in claim 1, wherein the receptacle of said force output member of said driving device has a polygonal cross section.

3. The window blind assembly as claimed in claim 1, wherein the receptacle of said force output member of said driving device has a tapered expanded orifice in a top side thereof.

4. The window blind assembly as claimed in claim 1, wherein the receptacle of said force output member of said driving device comprises two side openings spaced from each other at 180°; said at least one spring arm includes two spring arms extended from an inside wall of said receptacle and respectively suspended in said side openings.

5. The window blind assembly as claimed in claim 4, wherein the protruding engagement portions of said spring arms are smoothly arched, and said spring arms each have a straight free end downwardly extending from the respective protruding engagement portion.

6. The window blind assembly as claimed in claim 1, wherein said receptacle of said force output member comprises at least one side opening; each said at least one spring arm has one end, on which a circular through hole is provided, fixedly fastened to said receptacle by a screw through the circular through hole, and another end, on which an oblong through hole is provided, movably fastened to said receptacle by a screw through the oblong through hole such that each said at least one spring arm is respectively suspended in said at least one side opening of said receptacle.

7. A control system for regulating light-shading status of a window blind assembly, comprising:

a transmission mechanism including a force receiving member having a receiving portion extended outside; and a driving device having a force output member detachably connected to the receiving portion of said force receiving member;

wherein said receiving portion of said force receiving member is substantially a rod member having a coupling groove extended around a periphery near a bottom end thereof; said force output member of said driving device has a receptacle connectable to the bottom end of said receiving portion of said force receiving member, said receptacle including a spring arm having a protruding engagement portion for engaging the coupling groove of said receiving portion of said force receiving member upon connection of said receptacle to said receiving portion of said force receiving member.

8. The control system as claimed in claim 7, wherein the receptacle of said force output member of said driving device has a polygonal cross section.

9. The control system as claimed in claim 7, wherein the receptacle of said force output member of said driving device has a tapered expanded orifice in a top side thereof.

10. The control system as claimed in claim 7, wherein the receptacle of said force output member of said driving device comprises two side openings spaced from each other at 180°, and two said spring arms extended from an inside wall of said receptacle and respectively suspended in said side openings.

11. The control system as claimed in claim 10, wherein the protruding engagement portions of said spring arms are smoothly arched, and said spring arms each have a straight free end downwardly extending from the respective protruding engagement portion.

12. The control system as claimed in claim 7, wherein said receptacle of said force output member comprises a side opening; said spring arm has one end, on which a circular through hole is provided, fixedly fastened to said receptacle by a screw through the circular through hole, and another end, on which an oblong through hole is provided, movably fastened to said receptacle by a screw through the oblong through hole such that the spring arm is suspended in said side opening of said receptacle.

* * * * *